US006948294B2

(12) United States Patent
Rabiea

(10) Patent No.: US 6,948,294 B2
(45) Date of Patent: Sep. 27, 2005

(54) METHOD OF PACKAGING POINT-OF-PURCHASE ITEMS

(76) Inventor: Jeffrey D. Rabiea, 4 Danton La. South, Locust Valley, NY (US) 11560

( * ) Notice: Subject to any disclaimer, the term of this patent is extended or adjusted under 35 U.S.C. 154(b) by 0 days.

(21) Appl. No.: 10/893,600

(22) Filed: Jul. 16, 2004

(65) Prior Publication Data

US 2004/0255558 A1 Dec. 23, 2004

Related U.S. Application Data

(60) Division of application No. 10/461,047, filed on Jun. 13, 2003, which is a continuation-in-part of application No. 10/170,522, filed on Jun. 13, 2002, now abandoned.

(51) Int. Cl.[7] ..... B65B 43/26

(52) U.S. Cl. ..... 53/459; 53/473; 53/572; 53/384.1

(58) Field of Search ..... 53/459, 455, 570–572, 53/473, 562, 384.1

(56) References Cited

U.S. PATENT DOCUMENTS

| | | | | | |
|---|---|---|---|---|---|
| 3,027,065 | A | | 3/1962 | Lindquist et al. | |
| 3,254,468 | A | * | 6/1966 | Lerner | 53/459 |
| 3,254,828 | A | * | 6/1966 | Lerner | 53/459 |
| 3,298,156 | A | | 1/1967 | Lerner | |
| 3,298,580 | A | * | 1/1967 | Lerner | 225/106 |
| 3,328,939 | A | * | 7/1967 | Harris, Jr. et al. | 53/385.1 |
| 3,448,555 | A | * | 6/1969 | Shabram | 53/459 |
| 3,477,196 | A | * | 11/1969 | Lerner | 53/459 |
| 3,579,948 | A | * | 5/1971 | Lerner | 53/459 |
| 3,650,775 | A | | 3/1972 | Simon et al. | |
| 3,754,342 | A | * | 8/1973 | Santacroce et al. | 53/385.1 |
| 3,754,370 | A | * | 8/1973 | Hanson | 53/459 |
| 3,961,743 | A | | 6/1976 | Hollowell | |
| 3,979,050 | A | | 9/1976 | Cilia | |
| 4,201,029 | A | | 5/1980 | Lerner et al. | |
| 4,334,399 | A | * | 6/1982 | Onishi | 53/459 |
| 4,337,058 | A | | 6/1982 | Lerner | |
| 4,344,557 | A | | 8/1982 | Lerner | |
| 4,401,213 | A | | 8/1983 | Lerner | |
| 4,616,472 | A | * | 10/1986 | Owensby et al. | 53/459 |
| 4,904,092 | A | | 2/1990 | Campbell et al. | |
| 4,911,560 | A | | 3/1990 | Hoover et al. | |
| 4,938,608 | A | | 7/1990 | Espinosa | |
| 5,170,957 | A | | 12/1992 | Carpenter | |
| 5,209,371 | A | | 5/1993 | Daniels | |
| 5,246,110 | A | | 9/1993 | Greyvenstein | |
| 5,290,104 | A | | 3/1994 | Sengewald | |
| 5,307,935 | A | | 5/1994 | Kemanjian | |
| 5,310,056 | A | * | 5/1994 | Ball | 383/37 |
| 5,335,788 | A | | 8/1994 | Beasley et al. | |
| RE34,856 | E | | 2/1995 | Daniels | |
| 5,413,412 | A | | 5/1995 | Odabashian | |
| 5,417,639 | A | | 5/1995 | Cronauer | |
| 5,562,580 | A | | 10/1996 | Beasley et al. | |
| 5,611,627 | A | | 3/1997 | Belias et al. | |
| 5,921,390 | A | | 7/1999 | Simhaee | |

(Continued)

*Primary Examiner*—Stephen F. Gerrity
(74) *Attorney, Agent, or Firm*—Edward W. Goebel, Jr.; Jon L. Woodard; MacDonald Illig Jones & Britton LLP

(57) ABSTRACT

A method of packaging point-of-purchase items involves supplying plastic bags as a continuously attached length of bags, each bag being separated from adjacent bags along the supply length by a perforated tear line. The length of bags is stored on a storage form or in another suitable manner permitting advancement of bags when pulled out of the stored condition. The perforated tear line cuts entirely through the web of bags. However, the perforation along one side of each bag is broken to present an open flap through which contents can be added to the bag prior to removal from the web. The method of using the bags for packaging produce, groceries or other articles generally selected at point of sale and which are generally segregated by type for later pricing by weight or unit, permits a user to at least partially fill a bag prior to removal from the web.

24 Claims, 12 Drawing Sheets

U.S. PATENT DOCUMENTS 5,957,824 A 9/1999 Lerner et al.
6,135,281 A 10/2000 Simhaee
6,199,349 B1 3/2001 Lerner
6,379,292 B1 4/2002 Simhaee
6,446,811 B1 9/2002 Wilfong
6,481,594 B1 11/2002 Yeh et al.
6,499,278 B2 12/2002 Cronauer et al.
6,543,201 B2 4/2003 Cronauer et al.
6,789,963 B2 * 9/2004 Brahier et al. ..... 400/120.16
2002/0020648 A1 2/2002 Lam et al.
2002/0160896 A1 10/2002 Yeh et al.
2002/0170937 A1 11/2002 Yeh et al.

* cited by examiner

METHOD OF PACKAGING POINT-OF-PURCHASE ITEMS

CROSS-REFERENCE TO RELATED APPLICATIONS

This is a divisional application of co-pending U.S. patent application Ser. No. 10/461,047, filed Jun. 13, 2003, which is a continuation-in-part of U.S. patent application Ser. No. 10/170,522, filed Jun. 13, 2002 (now abandoned). This application takes priority from both application Ser. No. 10/461,047 and 10/170,522, both being incorporated herein by reference.

BACKGROUND

The present invention relates to a method for packaging point-of-purchase items using a web of pre-opened bags in a compact dispensing format.

Plastic bags stored in bulk, for example, on supply rolls containing a plurality of attached bags, have conventionally been provided in supermarkets and other locations to provide the consumer with a convenient means for packaging items, such as, for example, articles of produce and other groceries, selected for purchase. Since, typically, fruits and vegetables are uniquely priced per unit of weight, packaging each type of produce in its own separate bag permits simplified determination of price at checkout, while concomitantly protecting the contents from contamination, damage and moisture loss. The lightweight nature of the bags obviates the need for taking a tare weight of the bag prior to weighing of the merchandise, further adding to the convenience attendant their use.

Heretofore, such bags have typically been provided on webs contained on continuous supply rolls having tear lines between adjacent bags to readily permit separation of individual bags from the remainder of a supply roll. Once removed, a bag is typically opened at the tear line and contents may then be inserted therein. Since attached bags are initially separated at a tear line while on a supply roll, the bags must normally be removed from the roll in order to permit filling with produce or other items. This can prove to be inconvenient, especially if a person's hands are full. It is also often difficult to open such bags since, as a result of a manufacturing process, a bag opening can cling together, sometimes as the result of static electricity. Frequently such bags can be difficult to open when a user's hands are cold or excessively dry. It can also be difficult for a user to perceive the location or the correct end of a bag at which the opening is positioned.

In some applications, a supply roll containing a web of bags is part of a larger storage form that allows the supply roll to rotate freely as each bag is being dispensed. However, such permitted free rotation of the supply roll can further complicate the dispensing of bags, especially if the user's hands are full, cold or dry, or if there is static cling or other inherent difficulties encountered while attempting to detach and/or to open a bag from the web. Frequently, such encountered difficulties can cause the accidental dispensing of multiple bags from the freely rotating supply roll. This can significantly increase retailer costs and detract from the general tidiness and appearance of the area immediately surrounding the storage form due to sloppy supply roll unfurling and the local accumulation of unwanted dispensed or partially dispensed bags. Free rotation of the supply roll could also complicate the opening of a bag prior to removal from the web.

It would therefore be highly desirable to provide a bag that is supplied from a continuously attached web of bags that would permit a user to easily open and fill each bag as it is being dispensed from a supply roll without requiring each bag to be first removed from the continuous web. Furthermore, a method of packaging using such pre-opened bags would also provide an advantage over conventionally practiced point-of-purchase packaging methods by virtue of the fact that the additional user step of opening each bag prior to filling would be eliminated. In addition, configuring a storage form to restrict free rotation of a supply roll and to increase bag tension would further enhance the dispensing and usefulness of such pre-opened bags.

SUMMARY

A method of packaging point-of-purchase items involves a web of pre-opened bags supplied in a continuously attached supply length in which each pre-opened bag is separated from an adjacent bag by a tear line. A seal, which runs co-directionally with the tear line, forms a closing near the bottom of each pre-opened bag such that when a bag is separated along the tear line from a remainder of the supply length, the bag is enclosed along three of its four edges, enabling containment of produce or other items placed therein via the opening at the fourth and remaining insertion edge of the bag which is coextensive with the tear line. The supply length of bags is advantageously stored on a roll or is fan folded, bundlized, or compactly stored in another suitable web manner to permit advancement of consecutive bags when pulled from the stored web condition by a user. Each tear line extends entirely across the continuous web supply of bags. However, the tear line along one side or ply of each bag is broken to form an insertion edge such that each bag, while the other side of each bag is still attached to the web, presents an open end through which contents can be added to prior to the dispensing of the bag. The side of each pre-opened bag that is broken along the tear line defines an open ply and the side of each bag that remains attached along the tear line defines an attached ply.

In one embodiment, an insertion edge of the open ply is at least partially separated from at least one of the open ply and the attached ply of the bag adjacent it on the tear line and the open ply is capable of extending to a position substantially flush with the tear line between them. However, at least one of the insertion edge of the open ply of the bag and the open ply of the second bag are at least partially folded back from the tear line making it easier for a purchaser to grip the insertion edge.

Briefly stated, a method of using the above described pre-opened bags for packaging of produce, groceries or other articles generally selected at point-of-purchase, and which are generally segregated by type for later pricing by weight or unit, permits a user to at least partially fill a bag prior to removal from a web of bags.

Although not intended to be limiting to the invention as broadly contemplated, pre-opened bags produced in accordance with the invention can typically present dimensions between about 10"w×14"h and about 12"w×20"h. Some embodiments of the invention may include pre-opened bags as large as 16"w×24"h or larger. Such dimensions are deemed to provide a suitable accommodating volume to meet the needs of a consumer encountered in connection with the above range of uses. In addition, although similarly not intended to be limiting to practice of the disclosed method in accordance with the invention, a wall thickness of the bags of less than about 1.50 mils (thousandths of an inch) can, for some applications, be deemed advantageous to practice of the invention. In some typical applications, a wall thickness of the bags produced in accordance with the invention lies in a range of about 0.3 mils to about 0.9 mils.

Some specific embodiments of the invention also include a storage form that is capable of producing tension as pre-opened bags from a web are pulled, the additional tension allowing for at least the partial drawing apart of plies during the dispensing of the pre-opened bags.

The above, and other objects, features and advantages of the present invention will become apparent from the following description read in conjunction with the accompanying drawings. Those skilled in the art will realize that this invention is capable of embodiments that are different from those shown and that details of the invention can be changed in various manners without departing from the scope of this invention. Accordingly, the drawings and descriptions are to be regarded as including such equivalent packaging methods that do not depart from the spirit and scope of this invention.

DETAILED DESCRIPTION OF THE INVENTION

Figure 1:
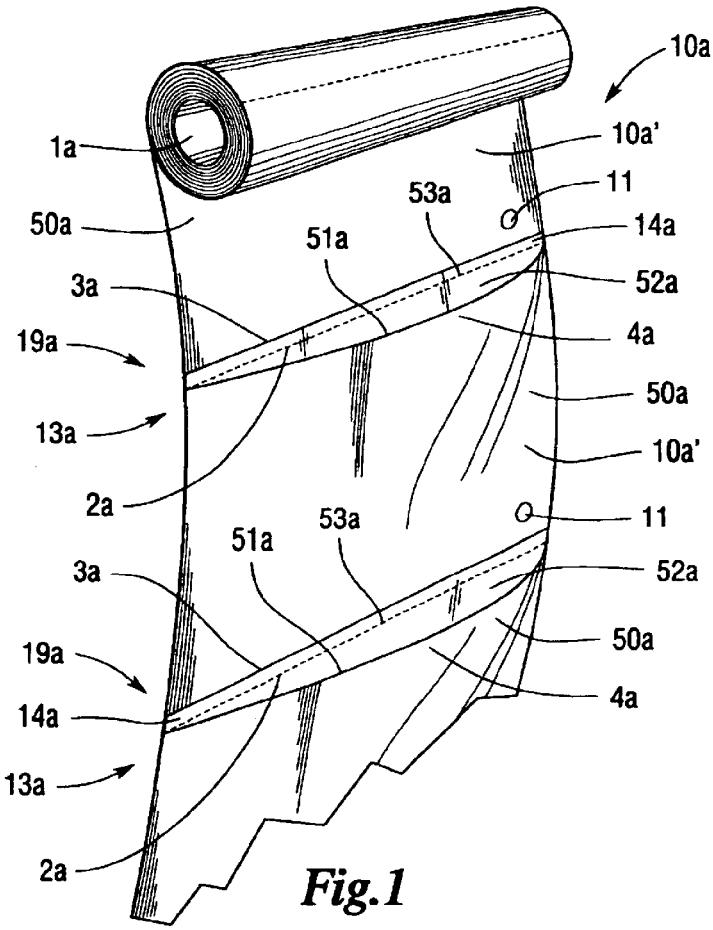
FIG. 1 is a perspective view of a web of continuously attached pre-opened bags on a supply roll in accordance with an embodiment of the invention shown partially unrolled.

Referring to the drawings, similar reference numerals are used to designate the same or corresponding parts throughout the several embodiments and figures. In some drawings, some specific embodiment variations in corresponding parts are denoted with the addition of lower case letters to reference numerals.

In FIG. 1, a web of continuously attached plastic pre-opened bags is depicted generally at 10*a*. The web 10*a* supplies a continuous bulk supply of individual pre-opened bags 10*a*', that are provided on a supply roll 1*a*. As part of the web 10*a*, each pre-opened bag 10*a*' is separated from an adjacent bag 10*a*' by a perforated tear line 2*a* extending through the web of bags 10*a* crosswise to a supply length of the continuous web 10*a*. Although the tear line 2*a* is shown and described in FIG. 1 as being perforated, it will be appreciated that other appropriate methods of allowing for the easy detachment of adjacent bags 10*a*, such as but not limited to linearly reducing bag thickness, razor slitting, fold weakening, and the like are also contemplated to be within the intended invention scope.

Each bag 10*a*' is also sealed at a seal end 19*a* adjacent the tear lines 2*a* along a seal 3*a*, such that when the bag 10*a*' is removed from the web 10*a*, it can suitably retain contents placed therein. The pre-opening of each bag 10*a*' occurs along the tear line 2*a* during manufacture by breaking the tear line 2*a* on one side of the bag 10*a*' only near an open end 13*a*. The side of each pre-opened bag 10*a*' that is broken along the tear line 2*a* defines an open ply 50*a* and the side of each bag 10*a*' that remains attached along the tear line 2*a* defines an attached ply 52*a*. The open ply 50*a* and attached ply 52*a* each have respective insertion edges 51*a* and 53*a* at the open end 13*a* that are each defined as the side of each ply adjacent the tear line 2*a*. Breaking the tear line 2*a* only along the open ply 50*a* forms a flap 4*a* at the open end 13*a* that defines an entry point into the pre-opened bag 10*a*' through which produce or other items can be inserted without requiring removal of the bag 10*a*' from the web 10*a*. A small excess portion 14*a* of the open and attached plies 50*a* and 52*a* remains between the seal 3*a* and tear line 2*a* connecting the adjacent bag 10*a*'. At least a portion of the insertion edge 53*a* of the attached ply 52*a* remains connected to the tear line 2*a*, thereby maintaining attachment of the bag 10*a*' to an adjacent bag of the web 10*a* until intentionally detached by a user.

A vent 11 is located on the open ply 50*a* to facilitate the evacuation of air from the interior of the bag 10*a*' during the manufacturing process. The vent 11 is located at a position on the open ply 50*a* that is adjacent the seal 3*a* and/or at the seal end 19*a* to minimize the amount of air that is trapped away from the insertion edge 53*a* of the open ply 50*a* as air is squeezed between the open ply 50*a* and attached ply 52*a*.

It will be appreciated that the vent 11 can also be positioned on the attached ply 52*a* or at any other location that is suitable for allowing air to escape from within the bag 10*a*'. The size and specific configuration of the vent 11 will be generally sufficient to securely prevent the loss of stored point-of-purchase items therethrough. It will be further appreciated that in some embodiments, the vent 11 can be omitted to allow for improved air tightness of the bag 10*a*'.

Use of the bags 10*a* produced in accordance with the embodiment of the invention depicted in FIG. 1 is intended to provide particular advantage in the specific venue of groceries, produce stores, supermarkets, etc., and in accordance with which, articles generally provided as bulk commodities and selected by a consumer at a point-of-purchase, and which items are routinely segregated by particular type for later unique pricing by weight or unit, may be conveniently packaged and brought to a register for checkout. Such advantageous use permits a user (i.e., most commonly a consumer) to at least partially fill a bag prior to removal from a web of plural bags, providing added convenience and shopping ease.

Although not intended to be limiting to the contemplated scope of the invention, bags produced in accordance with the invention can advantageously present dimensions between about 10"×14" and about 12" and 20" (width×height), though some specific embodiments may have dimensions in the approximate range of 8"×10" or smaller. Some embodiments of the invention may include pre-opened bags as larges as 14"w×24"h. In some embodiments of the invention, such dimensions can provide a suitable accommodating volume to meet the needs of a consumer utilizing the bags within the above-noted range of uses. In addition, although similarly not intended to be limiting to practice of the disclosed method in accordance with the invention, such pre-opened bags can be typically produced from either high or low density polyethylene, or like material, though high density polyethylene may be preferred for smaller bag thickness. A wall thickness of the bags of less than about 1.50 mils (thousandths of an inch) can for some applications be deemed advantageous to practice of the invention. In some typical application, an example wall thickness could lie in the approximate range of about 0.3 mils to about 0.9 mils. Within such a range, the use of a high density polyethylene may be preferred for bag thicknesses under about 0.7 mils.

Figure 2:
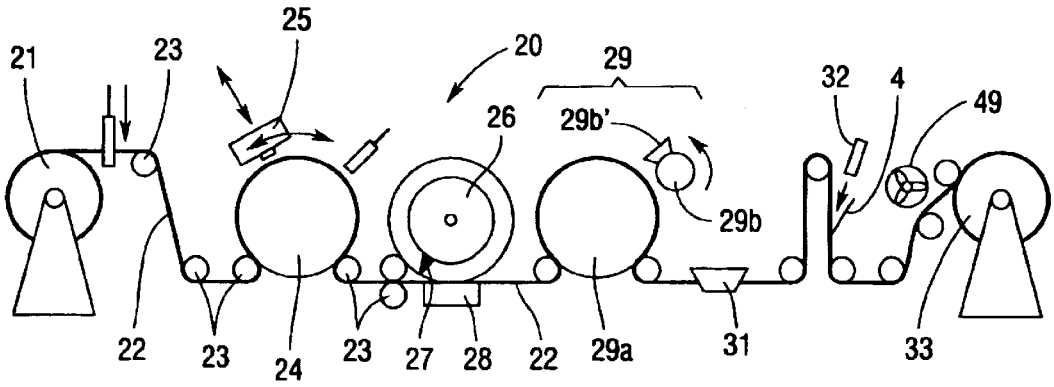
FIG. 2 is a schematic view of a production line for producing a web comprising a length of continuously attached bags in accordance with an embodiment of the invention.

Referring now to FIG. 2, a conversion machine 20 for manufacturing the bags 10*a*' in accordance with the invention is schematically depicted. It is noted that the described production line utilizing the conversion machine 20 is disclosed merely as a production example of the bags 10*a*' according to the invention, and it is not intended to be exhaustive of possible conventional and inventive machinery, and production methods, which could be employed with suitable effectiveness in achieving the objectives of the invention, without departure from the invention.

As shown in FIG. 2, a supply of raw material, for example extruded thermoplastic tubing (e.g. polyethylene, polypropylene, or any other suitable plastic material heretofore known or developed in the future, etc.), is fed from a payout roll 21 as a web 22 via feed and guide rollers 23, using conventionally practiced transport and operational technology encountered in the typical manufacture of continuous plastic bags. The web of raw material 22 is directed to a rotating drum 24 about which the web 22 is contractably guided. A heat sealer 25 is moved radially inward to the drum 24 to contact the web of raw material 22 at intermittent intervals, and circumferentially follows a rotational movement of the drum 24 while in contact with the web 22, thereby heat-sealing the web at a selected spaced apart distance determined by a desired bag height, and forming a seal that is generally the seal 3 shown in FIG. 1. When brought out of contact with the web of raw material 22, the heat sealer 25 is moved circumferentially backward to return the same to a starting position in anticipation of a subsequent sealing operation as described.

The web of raw material 22 next passes to a serrator 26 which includes a perforating blade 27 that rotates with the serrator 26 and contacts and perforates the web 22 drawn between the serrator 26 and a stationary support bar 28. This allows for the formation of a perforation tear line 2 (see FIG. 1) in the web 22 at a location there along adjacent to the previously formed seal 3.

A scuffer section 29 is provided downstream of the serrator 26 for purposes of breaking the tear line 2 on one side of the web 22. The scuffer section 29 includes a support, conveniently provided in the form of a rotating drum 29*a*, and a scuffer pad assembly 29*b* that rotates counter-directional to rotating drum 29*a*. The scuffer pad assembly 29*b* includes one or more scuffer pads 29*b*' made of suitable material, for example, rubber, which presents sufficient friction to open the bags on only one side along the tear line 2, and which intermittently contacts the web at the tear line 2 as the scuffer pad assembly 29*b* rotates. It will be understood that the pressure exerted by the scuffer pads 29*b*' on the web 22 will be adjusted based upon various parameters including bag thickness, perforation characteristics, material thickness, etc., such that one side of the tear line 2 is broken, while the integrity of the tear line 2 on a remaining side distant from the scuffer pads 29*b*', i.e. as attached to the insertion edge 53*a* of the attached ply 52*a* of FIG. 1, is at least partially maintained.

If a width of the bags 10*a*' produced in accordance with the invention requires adjustment from that of the extruded tubing transported as the web of raw material 22, a slit sealer 31 is provided which longitudinally slits and heat-seals the web 22 at a desired distance inwardly of the original outermost edge of the web of raw material 22.

The web 22 is then subjected to an air test to establish that the bags 10*a*' have been successfully scuffed open by utilizing a blower nozzle 32 that directs a stream of air to open the flap 4*a* (see also FIG. 1) in the bags 10*a*'. Thereafter, the web 22, which at this point has been converted into the continuously attached length of bags comprising the web 10 depicted in FIG. 1, is wound on to a pickup roll 33. Excess air present in each bag 10*a*' exits through the entrance to the bag 10*a*', located at the insertion edge 53*a* of the open ply 50*a*, and through the vent 11 as the web 22 is wound on to the pickup roll 33.

Figure 3:
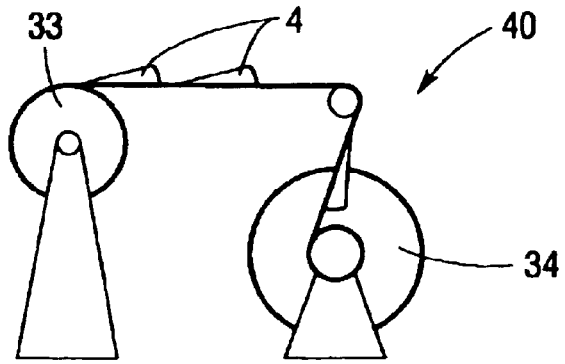
FIG. 3 is a schematic view of a rewinding station for providing a desired orientation of an opening of the bags relative to the continuous supply when dispensed therefrom.

Because of the particular configuration of the conversion machine 20 and the nature of transport of the web 22, a further step is required to orient the flap 4 with respect to the supply roll 1*a* as shown in FIG. 1. Referring now to FIG. 3, the pickup roll 33 serves as a payout roll when transferred to a rewinding station 40, in which it is rewound onto a rewind roll 34. As shown schematically, the flaps 4 are originally oriented such that the openings in the bags 10 would face downward if dispensed from the roll 33. By rewinding the bags onto the rewind roll, the desired orientation is achieved, as shown in FIG. 1, in which roll 1*a* corresponds to that produced on rewind roll 34.

Figure 4A:
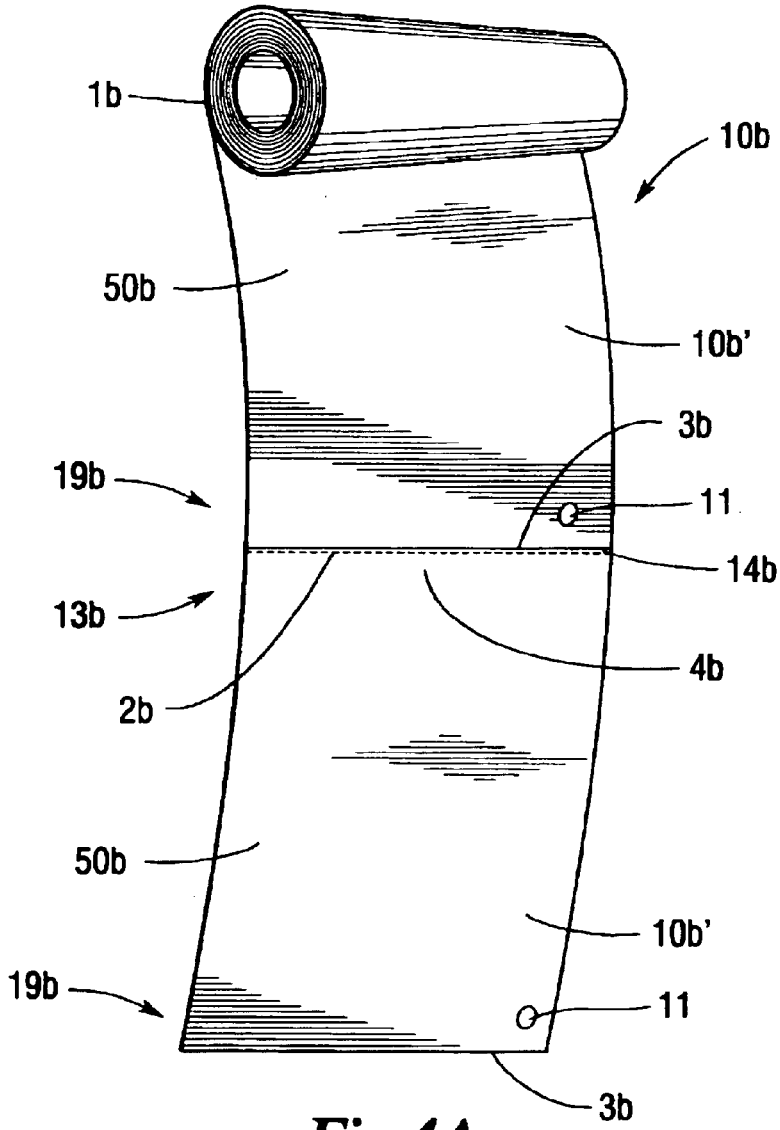
FIG. 4A depicts a web of continuously attached pre-opened bags according to one embodiment of the invention.

It will be appreciated that other manufacturing processes are possible and it is contemplated that such other manufacturing processes can be used to construct pre-opened bags that are within the intended scope of the invention. In the course of manufacturing such pre-opened bags, some processes, including the one depicted in FIGS. 2 and 3, can be arranged to effect folding or misalignment of open plies. For example, FIG. 4A depicts a web 10*b* of pre-opened bags 10*b*' in which the insertion edge 51*b* of each open ply 50*b* is capable, as shown in FIG. 4A, of extending to a position that is substantially flush with the tear line 2*b*. Although capable of extending to this flush position at the open end 13*b*, the insertion edge 51*b* will typically be at least partially and advantageously folded away from the tear line 2*b* with an adjacent bag 10*b*' of the web 10*b*.

Figure 4B:
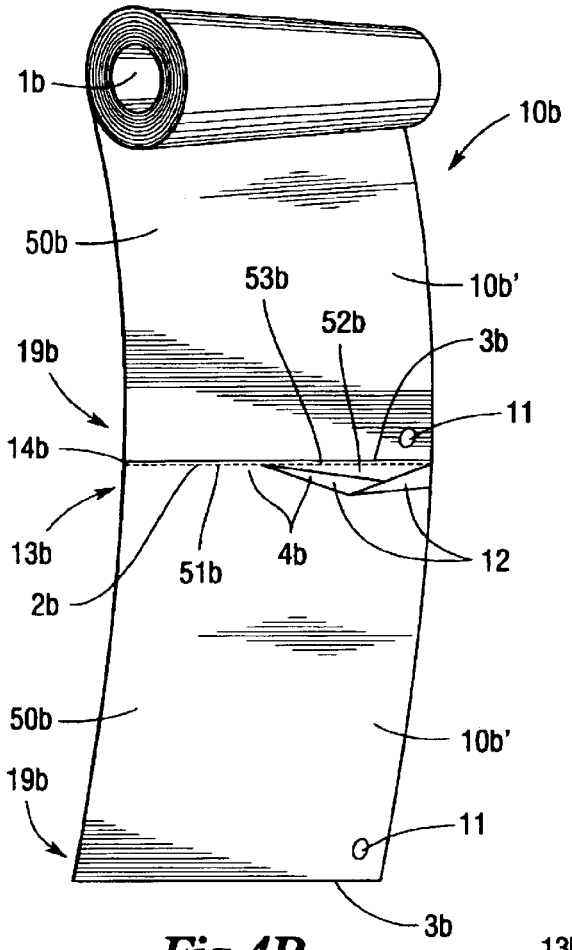
FIG. 4B depicts the web of continuously attached pre-opened bags of FIG. 4A having a partially folded insertion edge.

FIG. 4B depicts the web 10*b* of FIG. 4A in which an example of such partial folding of the insertion edge 51*b* from the tear line 2*b* is depicted. The result is the formation, at the open end 13*b* of the bag 10*b*', of an open end fold 12 along a portion of the insertion edge 51*b*. The open end fold 12 helps define the entry point of the bag 10*b*' as defined by the flap 4*b* and facilitates further separation of the open and attached plies 50*b* and 52*b* as a user opens the pre-opened bag 10*b*'. The folding can be accomplished during the manufacturing process by causing the insertion edge 51*b* to momentarily catch air immediately after manufacturing of each bag 10*b*' or later as the web 10*b* is wound from a payout roll to a pickup or rewind roll. Folding can also be effected by causing respective movement between the open ply 50*b* and attached ply 52*b* of each bag 10*b*' such that gathering or bunching along the insertion edge 51*b* of the open ply 50*b* moves the open ply 50*b* toward a folded position. Depending on the specific plastic material being used to form the web 10*b*, static electricity arising between adjacent layers of open and attached plies 50*b* and 52*b* can further contribute to folding motion. As a portion of the insertion edge 51*b* moves toward a folded position, the bag 10*b*' is wound on to the supply roll 1*b*, locking the moving portion of the insertion edge 51*b* to create the open end fold 12. An unfolded portion 51*b*' of the insertion edge 51*b* that does not catch air or otherwise fails to exhibit the folding motion may remain flush with the tear line 2*b* as the bag 10*b*' is wound on to the supply roll 1*b* with the rest of the web 10*b*. Additional agitation of the open ply 50*b* to effect folding can be provided with the placement of a fan, an additional air pressure nozzle, or other source of moving air placed in the vicinity of the web 10*b* during the manufacturing process. It is noted that such conditions will most effectively cause such folding where bags are larger than about 8"×10" or where smaller material thicknesses, such as below about 1 mil, are used. For example, referring to the example manufacturing process depicted in FIG. 2, such folding can typically be expected to occur during the manufacturing of webs of bags comprised of high-density polyethylene (HDPE) film bags having a material thickness of 0.45 mils where each bag measures approximately 15° h"×12w" by placing an electric fan 49 approximately six inches from the pick-up roll 33.

Figure 4C:
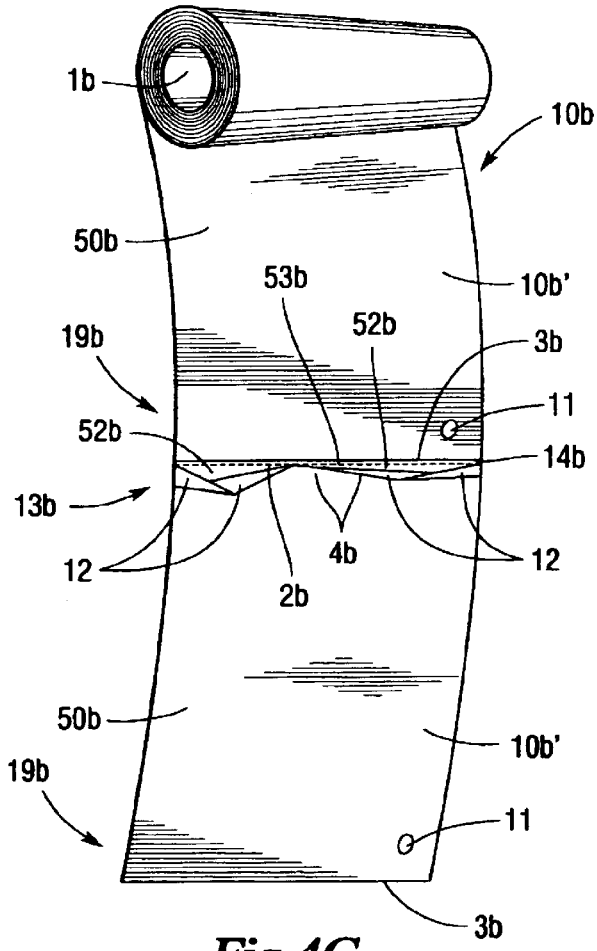
FIG. 4C depicts the web of continuously attached pre-opened bags of FIG. 4A having a partially folded insertion edge.

Depending on individual conditions during the manufacturing of each bag 10*b*', larger or multiple open end folds 12 may be caused to form along the insertion edge 51*b* such as to reduce the extent of the unfolded portion 51*b*' of the insertion edge 51*b*. An example of this is depicted in FIG. 4C, in which a bag 10*b*' of the web 10*b* of FIGS. 4A and 4B is depicted to have multiple open end folds 12 that have formed along the insertion edge 51*b*. Individual conditions leading to variations in the number, size, or orientation of open end folds 12 can depend on fluctuations or variations in surrounding air flow, equipment speed, ply structure, positioning, or other environmental, material, or equipment conditions that affect the manner in which individual bags 10*b*' are manufactured.

Figure 5A:
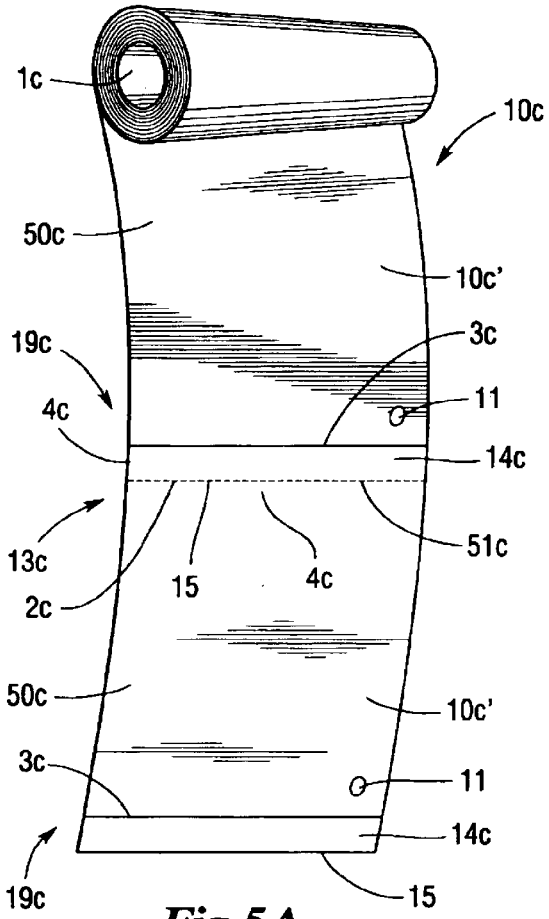
FIG. 5A depicts a web of continuously attached pre-opened bags according to one embodiment of the invention.

In some embodiments, individual conditions can also lead to variations in folds near the seal of each bag. FIG. 5A depicts a web 10*c* of bags 10*c*' in which each bag 10*c*' includes a seal 3*c* that is separated from the tear line 2*c* to form an enlarged excess portion 14*c* on the open ply 50*c* having an excess edge 15. FIG. 5A further depicts the enlarged excess portion 14*c* at the seal end 19*c* of the bag 10*c*' on the open ply 50*c* extending from the seal 3*c* to a position in which the excess edge 15 is flush with the tear line 2*c*.

The manufacturing process of this web 10*c* of pre-opened bags 10*c*' can also be arranged to effect folding or misalignment of the excess portion 14*c* so that the excess portion 14*c* does not extend to a position where the excess edge 15 is flush or substantially flush with the tear line 2*b*. As a result of such manufacturing processes, the excess portion 14*c* will typically be at least partially and advantageously folded away from the tear line 2*c* with an adjacent bag 10*c*' of the web 10*c*.

Figure 5B:
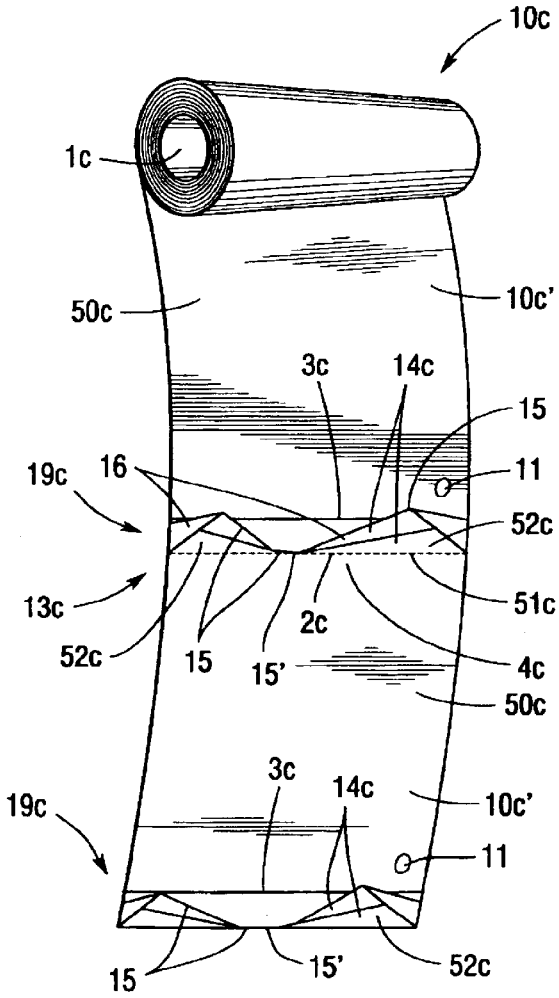
FIG. 5B depicts the web of continuously attached pre-opened bags of FIG. 5A having partially folded excess portions.
Figure 5C:
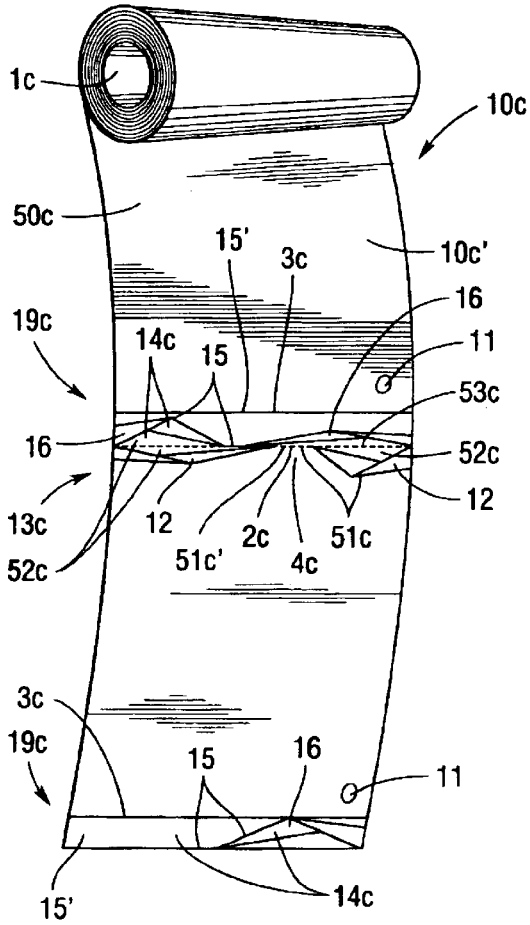
FIG. 5C depicts the web of continuously attached pre-opened bags of FIG. 5A having partially folded excess portions and a partially folded insertion edge.
Figure 5D:
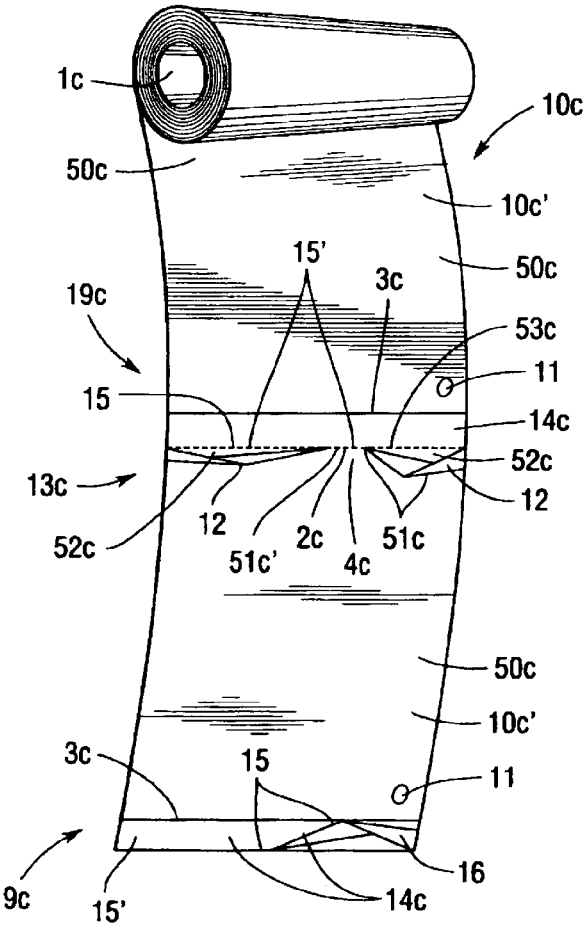
FIG. 5D depicts the web of continuously attached pre-opened bags of FIG. 5A having a partially folded excess portion and a partially folded insertion edge.

FIG. 5B depicts the web 10*c* of FIG. 5A in which an example of such partial folding of the excess portion 14*c* is depicted. The result is one or more seal end folds 16 along a portion of the excess edge 15. The one or more seal end folds 16 further help define the entry point into an adjacent bag 10*c*' that is attached at the tear line 2*c*, and further facilitates opening of the adjacent bag 10*c*'. Comparing FIGS. 5B and 5C, one or more seal end folds 16 can form concurrently with the formation of one or more open end folds 12 (as depicted in FIG. 5C), or in the absence of open end folds 12 (as depicted in FIG. 5B). Individual conditions leading to variations in the number, size, orientation, or combination of seal end folds 16 with open end folds 12 can also depend on fluctuations or variations in surrounding air flow, equipment speed, ply structure, positioning, or other environmental, material, or equipment conditions that affect the manner in which individual bags 10*c*' are manufactured. As best understood with reference to FIG. 5D, it is also possible to have seal end folds 16 entirely absent on one bag 10*c*' while one or more seal end folds 16 are present on an adjacent bag 10*c*'. Larger or multiple seal end folds 16 may also frequently form along the excess edge 15 such as to reduce the extent of the unfolded portion 15' of the insertion edge 15.

Like an open end fold 12 of an adjacent bag 10*c*', a seal end fold 16 can be created during the manufacturing process by causing an excess edge 15 to momentarily catch air immediately after the manufacturing of each individual bag 10*c*' or at a later time as the web 10*c* is wound from a payout roll to a pickup or rewind roll. Folding can also be effected by causing respective movement between the open ply 50*c* and attached ply 52*c* of each pre-opened bag 10*c*' between the seal 3*c* and tear line 2*c* to create gathering or bunching along the excess edge 15 of the excess portion 14*c*, moving the excess portion 14*c* toward a folded position. As with the open end fold 12, static electricity can contribute to the formation of the seal end fold 16 depending on the specific material being used to form the web 10*c*. Additional agitation of the open ply 50*b* to effect folding can be provided with the placement of a fan, an additional air pressure nozzle, or other source of moving air placed in the vicinity of the web 10*b* during the manufacturing process. It is noted that such conditions will most effectively cause such folding where bags are larger than about 8"×10" or where smaller material thicknesses, such as below about 1 mil, are used. Referring again to the example manufacturing process depicted in FIG. 2, such folding can typically be expected to occur during the manufacturing of webs of bags comprised of high-density polyethylene (HDPE) film bags having a material thickness of 0.45 mils, where each bag measures approximately 15h"×12w" and where the distance between the tear line and seal of each bag (excess portion length) measures between approximately 0.3" and 0.5", by placing an electric fan 49 approximately six inches from the pick-up roll 33.

As one or more portions of the excess edge 15 move toward a folded position, the bag 10*c*' is wound on to the supply roll 1*c*, locking the folding portion of the excess edge 15 to create the seal end fold 16. Any unfolded portion 15' of the excess edge 15 that does not catch air or otherwise fail to exhibit the folding motion may remain flush with the tear line 2*c* as the bag 10*c*' is wound on to the supply roll 1*c* with the rest of the web 10*c*. In some circumstances, the entire excess portion 14*c* may remain in a position such that the entire excess edge 15 remains substantially flush with the tear line 2*c*, as depicted in FIG. 5A and with the topmost of the unrolled pre-opened bags 10*c*' in FIG. 5D, though generally, at least one of the excess edge 14 or insertion edge 51*c* will fold over and act as a visual indication of the point of entry into the pre-opened bag 10 at the open end 13*c*.

Figure 6:
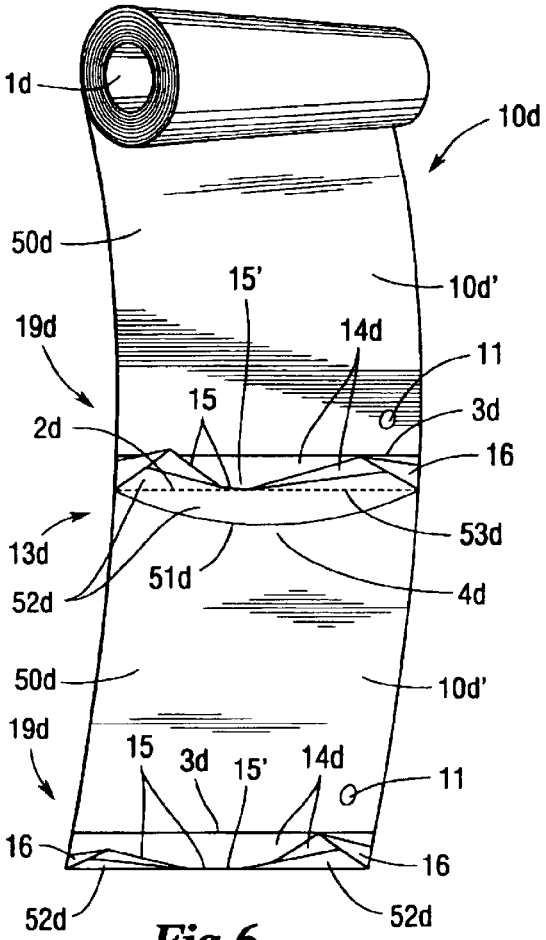
FIG. 6 depicts a web of continuously attached pre-opened bags according to one embodiment of the invention.

Additional visual indicators of the point of entry into the pre-opened bag 10 are also possible and contemplated to be within the scope of the invention. FIG. 6 depicts a web 10*d* of pre-opened bags 10*d*' that is similar to the web 10*c* of pre-opened bags 10*c*' depicted in FIGS. 5A–D, the slightly altered view depicting the flap 4*d* of the open ply 50*d* when it is separated from the attached ply 52*d* such that the point of entry into the pre-opened bag 10*d*' at the open end 13*d* is clearer to the open eye. Such separation between the flap 4*d* and attached ply 52*d* can be effected mechanically either during or after the manufacturing process as, for example, with blown air as in the possible manufacturing method described in the above description of FIGS. 2 and 3. The user can also effect separation manually at a later time. Such separation will generally begin to eliminate any existing open end fold that is present along the insertion edge 51*d*.

Figure 7:
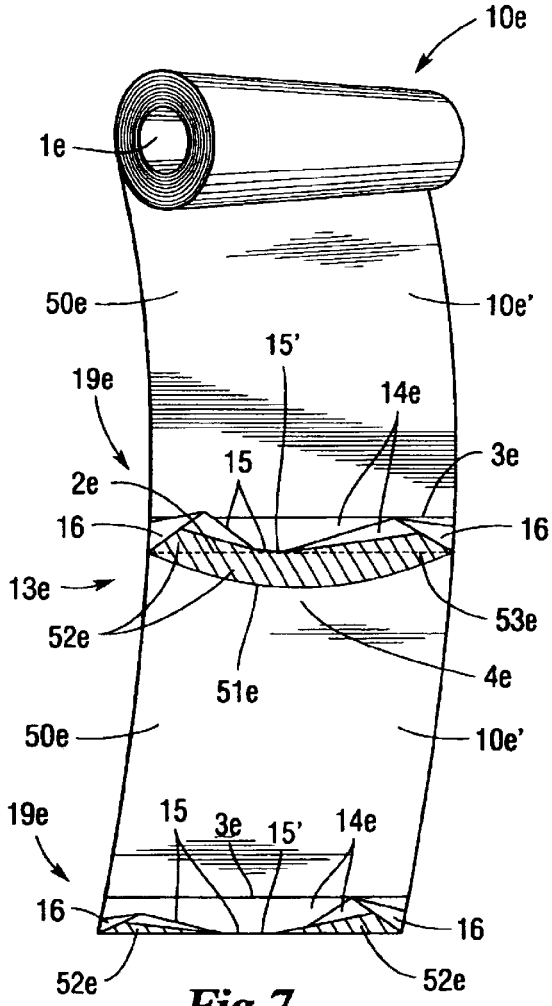
FIG. 7 depicts a web of continuously attached pre-opened bags according to one embodiment of the invention.

FIG. 7 depicts a possible visual indicator of the point of entry into each pre-opened bag 10*e*' of a web 10*e* in which the color of each open ply 50*e* is different from the color of the attached ply 52*e*. If either the insertion edge 51*e* or excess edge 15 of an adjacent bag are folded to create an open end fold or seal end fold, a portion of the attached ply 52*e* will be visible when looking toward the open ply 50*e* of the bag 10*e*' due to the color contrast between the plies. Normally, this color contrast will also be visible if the flap 4*e* of the open ply 50*e* is separated from the attached ply 52*e*, allowing for a quick visual determination of the location of the point of entry to the bag 10*e*' at the open end 13*e*.

Figure 8:
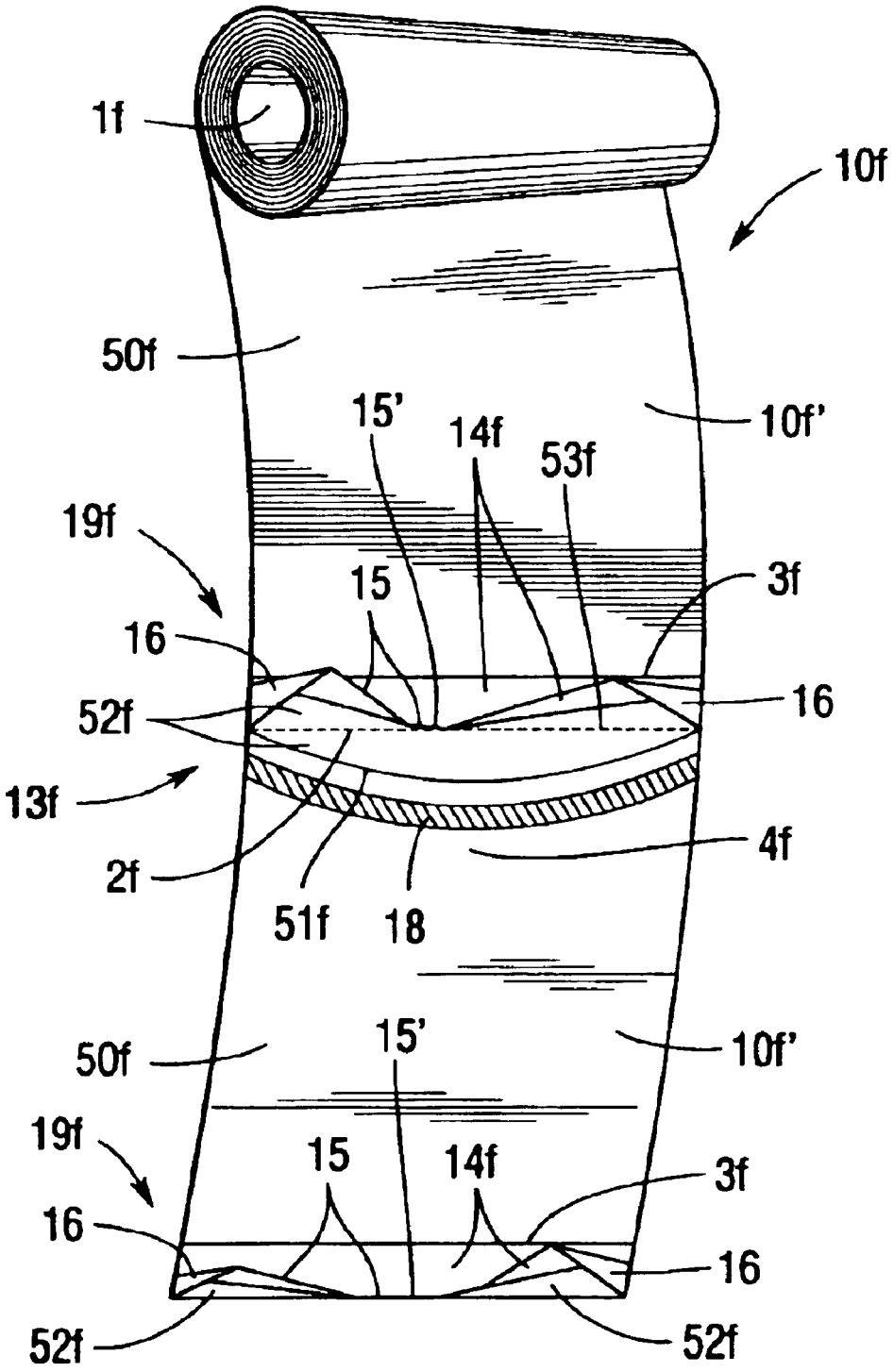
FIG. 8 depicts a web of continuously attached pre-opened bags according to one embodiment of the invention.

FIG. 8 depicts a web 10*f* of pre-opened bags 10*f*' that include visual indicators each comprising an indicator stripe 18 at the open end 13*f*. Each indicator stripe 18 can be formed from an ink or print line, sticker, other adhesive composition or impregnated coloration that is a contrasting color to the color of the open ply 52*f*. An indicator stripe 18 is normally positioned along the open ply 52*f* to follow the insertion edge 51*f*. When there is respective movement between the open ply 50*f* and attached ply 52*f*, such as when the bag 10*f* is grasped or pinched by the user, the indicator stripe generally moves with the insertion edge 51*f*, emphasizing the moving location of the point of entry to the bag 10*f*'.

Figure 9A:
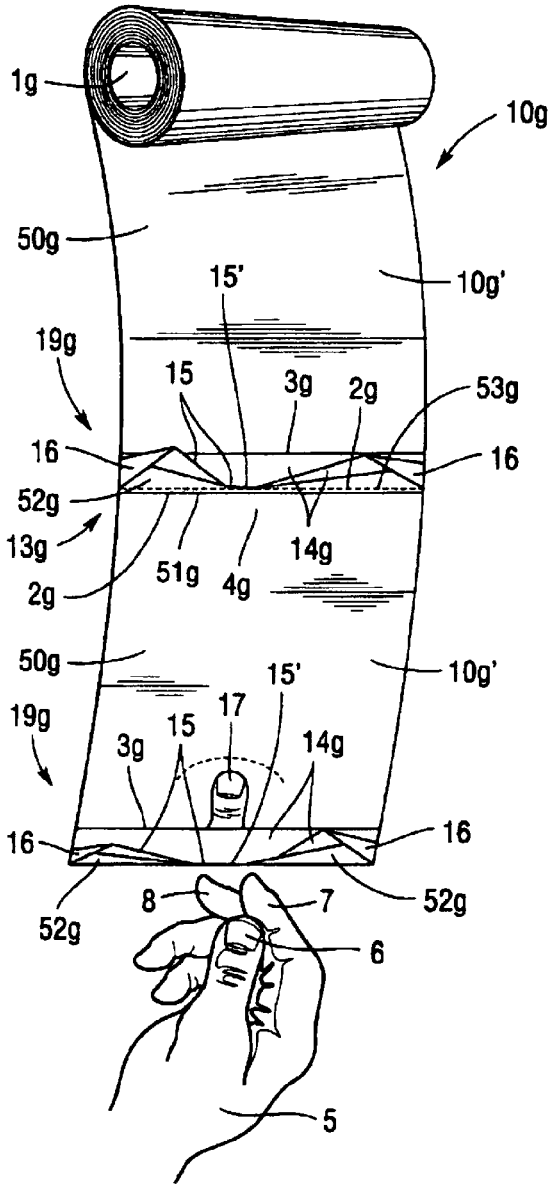
FIG. 9A depicts a web of continuously attached pre-opened bags according to one embodiment of the invention prior to being grasped and pulled by a user.

In some embodiments, an additional indicator can be used to assist the user in locating an appropriate grasping or pinching location to effect dispensing and further opening of a bag. FIG. 9A depicts a web 10*g* of pre-opened bags 10*g*' having a thumb icon indicator 17 that is printed on the open ply 50*g* of each bag 10*g*' adjacent the seal 3*g* at the seal end 19*g* to denote an appropriate location for grasping and pulling on the pre-opened bag 10*g*'. As shown, the thumb icon indicator 17 comprises an image of a human thumb, though it will be appreciated that other images denoting an appropriate grasping or pulling location can also be printed or adhered to a visible location of the open ply 50*g*. In the depicted embodiment, the thumb icon indicator 17 suggests to the user that the appropriate location for grasping the bag pre-opened 10*g*' is at the seal end 19*g* of the bag 10*g*' near the seal 3*g*. The hand 5 of the user approaches from beneath the bag 10*g*' to be dispensed so that the user's index finger 7 and middle finger 8 contact the attached ply 52*g* while the user's thumb 6 contacts the open ply 50*g* at the thumb icon indicator 17.

Figure 9B:
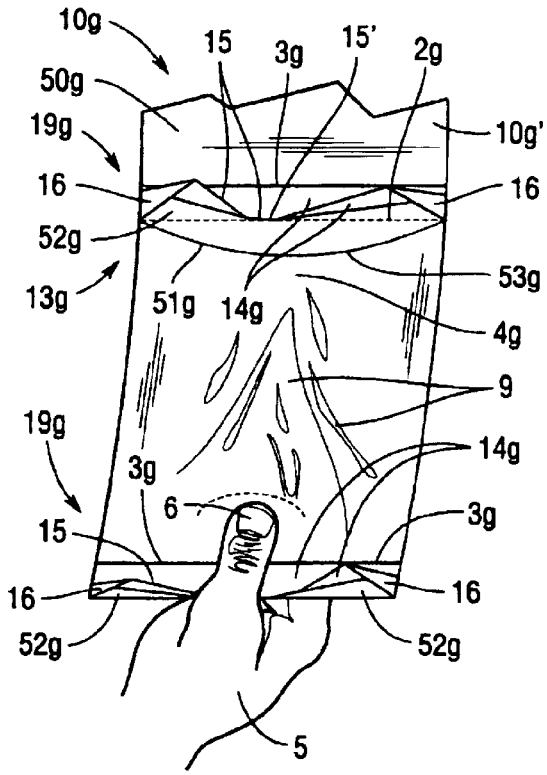
FIG. 9B depicts the web of continuously attached pre-opened bags of FIG. 9A being grasped and pulled by a user.

Comparing FIG. 9A with FIG. 9B, the user pinches the pre-opened bag 10*g*' with the index finger 7, middle finger 8, and thumb 6. A slight relative movement between the index finger 7 and middle finger 8 with the thumb 6 causes a slight relative movement between the open ply 50*g* and attached ply 52*g* that results in the formation of gathering 9 along the surface of the open ply 50*g*. Referring now to FIG. 9*b*, this gathering 9 tends to pull the insertion edge 53*g* of the open ply 50*g* downward and away from the tear line 2*g*, further visually indicating the point of entry into the pre-opened bag 10*g*' at the open end 13*g* and serving to further open the bag 10*g*'. Such icon indicators 17 can be used in conjunction with other visible indicators of the point of entry into each bag 10*g*', such as those depicted in FIGS. 5B-D, 7, and 8, and as described above, to further facilitate bag opening and use.

Figure 10:
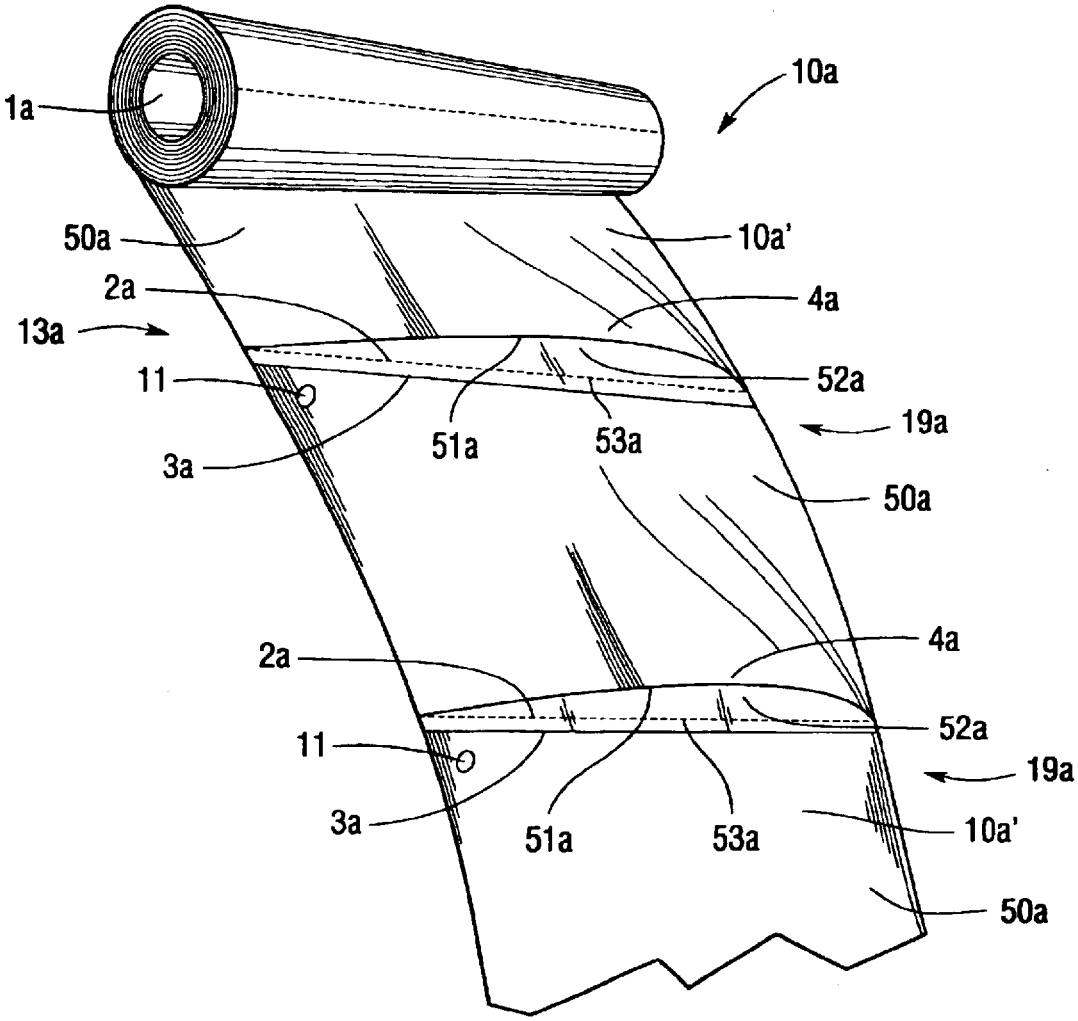
FIG. 10 is a perspective view of the web of continuously attached pre-opened bags of FIG. 1 after being rewound on a supply roll.

The invention has been shown and described in various embodiments in which a web of bags is stored on a supply roll and dispensed to allow the seal of a first bag to lead off of the roll to allow the insertion edge of an open ply to be adjacent a tear line connecting the first bag to a second bag that is further from the end of the web (i.e., further away from being dispensed). In some embodiments, this allows a user to at least partially fill a bag prior to removal from the web. However, it will be appreciated that in some embodiments and under some circumstances of use, it may be advantageous to configure the invention to allow the insertion edge of an open ply of a second bag to lead off of the roll, allowing the seal of the second bag to be adjacent a tear line separating the second bag with a first bag. As an example of such a configuration, FIG. 10 depicts the web 10*a* of bags 10*a*' of FIG. 1 prior to being transferred to a rewind roll 34 of the rewinding station 40. Such a configuration could also be achieved by again rewinding the rewind roll 34 of the web 10*a* in FIG. 3 on to a secondary rewind roll (not shown) or otherwise reversing the dispensing order of subsequent pre-opened bags 10*a*' of the web 10*a* as required by the specific circumstances of use.

The invention can be used in conjunction with a storage form to further facilitate bag opening by increasing tension as individual bags are dispensed from a supply roll. Many such embodiments of the invention will include a locking device such as a ratchet, core-lock, tightly mounted supply roll, or similar device to increase tension.

Figure 11A:
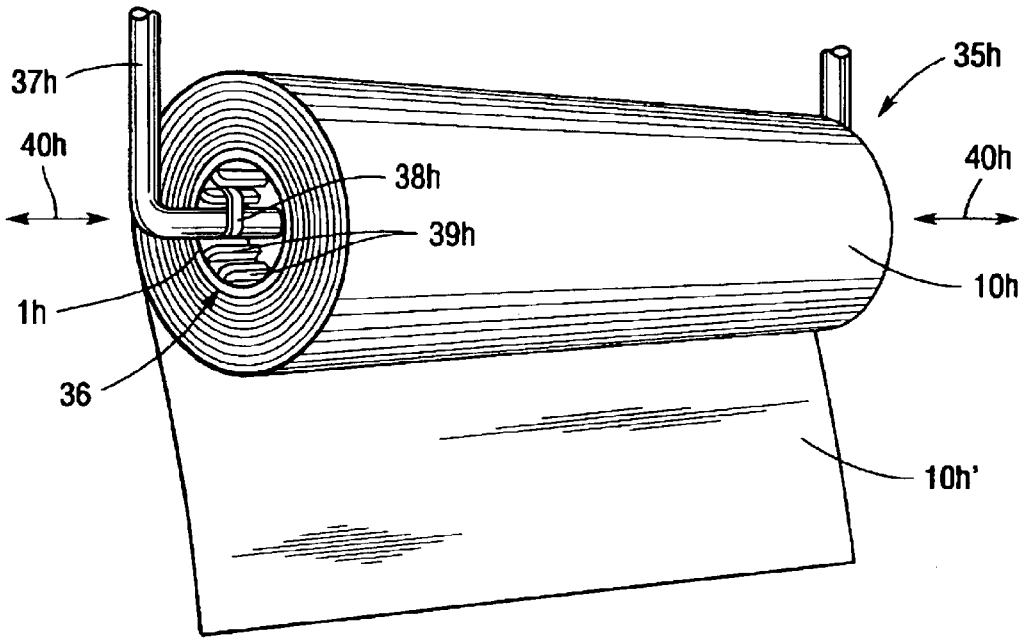
FIG. 11A depicts a web of continuously attached pre-opened bags contained on a storage form according to one embodiment of the invention.

FIG. 11A depicts one embodiment of a storage form 35*h* in which a supply roll 1*h* is mounted on a dispensing rack 37*h*. A step ratchet 36 includes a flexible pawl 38*h* mounted to the supply roll 1*h* and positioned to engage multiple, evenly spaced ratchet teeth 39*h* that extend inward from the inside surface of the supply roll 1*h*. The pawl 38*h* is curved to allow the supply roll 1*h* to rotate in one direction only. When a user pulls a bag 10*h*' from the supply roll 1*h*, the step ratchet 36 produces minor hesitations, or incremental tensional increases against the force of the pulling action as the supply roll 1*h* rotates about its axis 40. The number of hesitations that occur during a single complete rotation of the supply roll 1*h* depends on the number of ratchet teeth 39*h* that are present within the supply roll 1*h*. As the user continues to pull a bag 10*h*' from the web 10*h*, the increased tension of each hesitation serves to cause further relative movement between the open and attached plies of the bag 10*h*' being dispensed, further defining the entry point into the bag 10*h*' at the open end 13*h*. Depending on the magnitude of the pulling force exerted by the user, the hesitations can also aid in detachment of the bag 10*h*' from the web 10*h*.

Figure 11B:
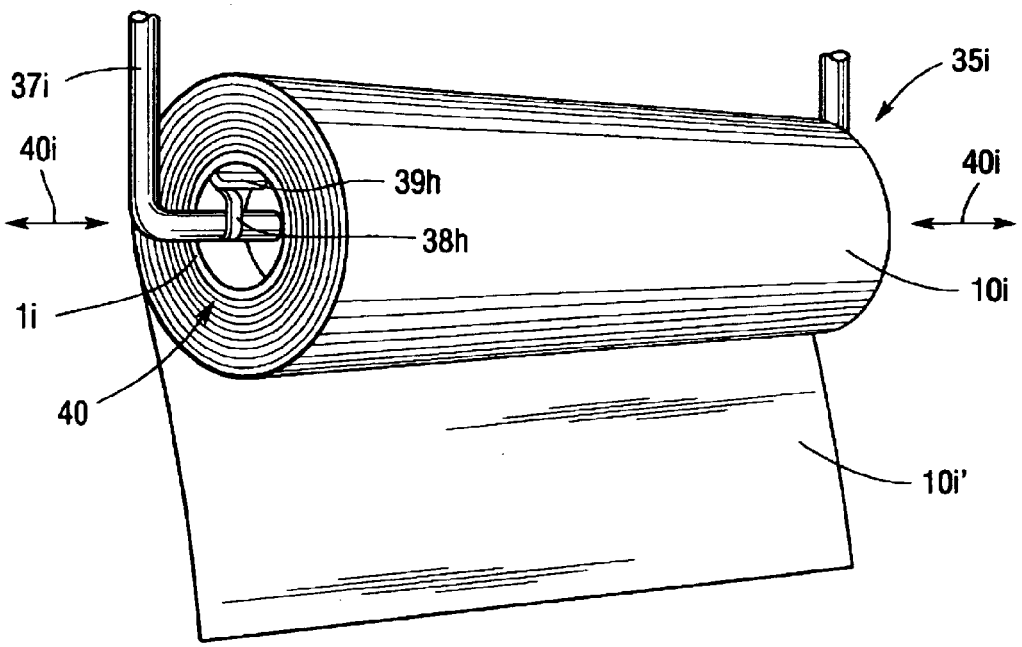
FIG. 11B depicts a web of continuously attached pre-opened bags contained on a storage form according to one embodiment of the invention.

FIG. 11B depicts an embodiment storage form 35*i* in which a supply roll 11 is mounted on a dispensing rack 37*i* that incorporates an inertial ratchet 40. The inertial ratchet 40 includes a flexible pawl 38*i* mounted to a dispensing rack 37*i* and positioned to engage a single ratchet tooth 39*i* that extends inward from one point along the inside surface of the supply roll 1*i*. The pawl 381 is curved to allow the supply roll 1*i* to rotate in one direction only.

When a user pulls a pre-opened bag 101' from the supply roll 1*i*, the inertial ratchet 36 allows the supply roll 1*i* to rotate by as much as one complete rotation before exerting a tensional increase or hesitation against the pulling force of the user. In some embodiments, the length of a bag 10*i*' of the web 10*i* will be on the order of one arc length of the supply roll 1*i*, depending on the number of pre-opened bags 10*i*' that remain on the roll 1*i*. As the user continues to pull the bag 10*i*', the supply roll 1*i* rotates about its axis 40*i*, accumulating angular momentum. Once the pawl 38*i* strikes the ratchet tooth 39*i*, the sudden hesitation of the rotation of the roll 1*i* contrary to its accumulated angular momentum serves to cause further relative movement between the open and attached plies of the pre-opened bag 10*i*' being dispensed, further defining the entry point into the bag 10*i*'. Depending on the magnitude of the pulling force exerted by the user and/or the total accumulated momentum of the rotating supply roll 1*i*, the sudden hesitation can also aid in detachment of the pre-opened bag 10*i*' from the web 10*i*.

Figure 12:
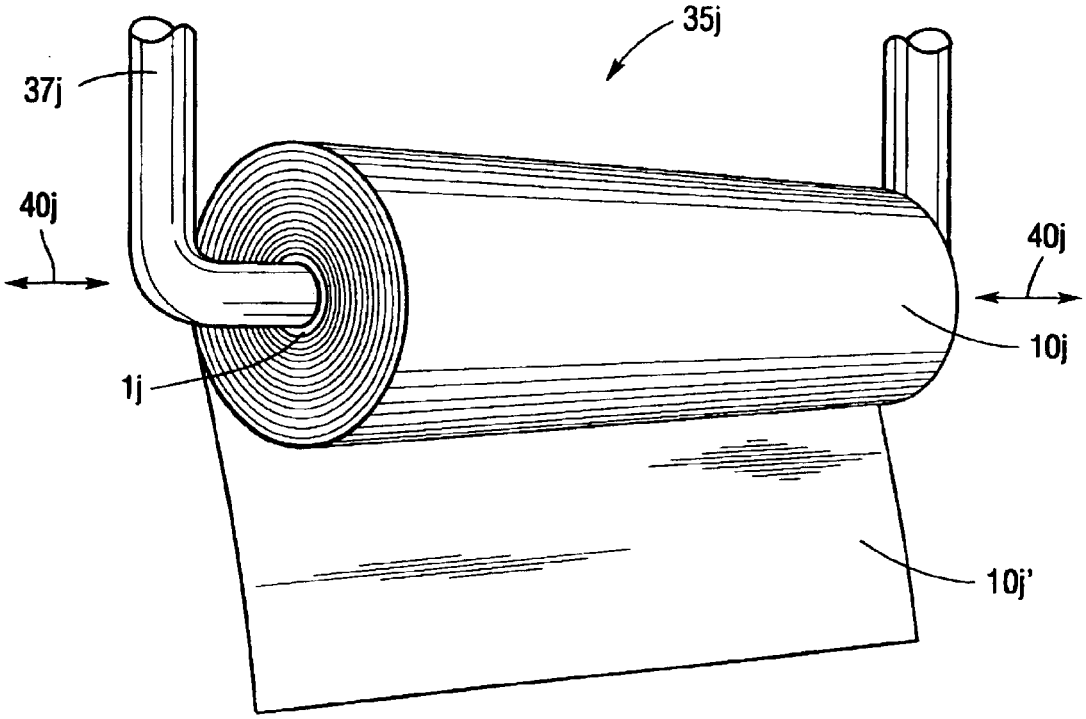
FIG. 12 depicts a web of continuously attached pre-opened bags contained on a storage form according to one embodiment of the invention.

The invention can also be configured with a storage form that constantly increases tension by continuously increasing resistance against rotation of the supply roll. For example, FIG. 12 depicts a storage form 35*j* that includes a storage rack 37*j* inserted tightly into the supply roll 1*j*. The tight insertion of the storage rack 37*j* causes substantial frictional resistance between the outside rolled surface of the storage rack 37*j* and inside rolled surface of the supply roll 1*j* as the roll 1*j* rotates about its axis 40*j*. As the user continues to pull a pre-opened bag 10*j*' from the web 10*j*, the constant increased tension serves to cause further relative movement between the open and attached plies of the bag 10*j*' being dispensed, further defining the entry point into the bag 10*j*' and possibly aiding in detachment of the bag 10*j*' from the web 10*j*.

Figure 13A:
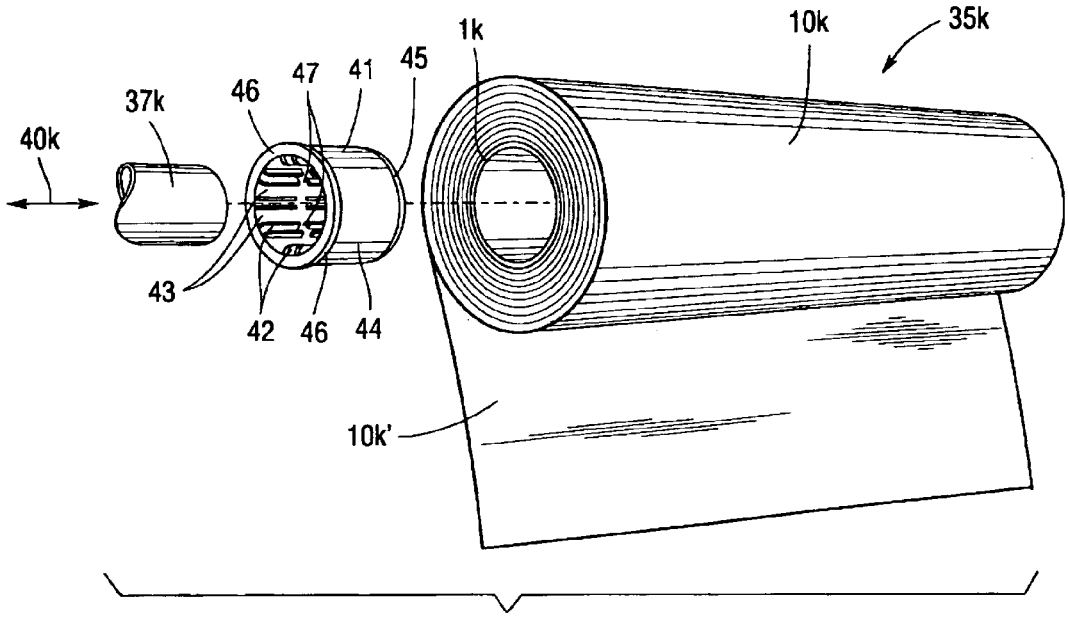
FIG. 13A is an exploded perspective view of a web of continuously attached pre-opened bags contained on a storage form according to one embodiment of the invention.

FIGS. 13A and B depict a storage form 35*k* having a core lock 41 for insertion into either end of a supply roll 1*k*. The core lock 41 includes multiple inward extending, flexible ribs 42 positioned in pairs around the rolled inside surface 43 of the core lock 41. As best understood from the exploded view of the storage form 35*k* in FIG. 13A, the rolled outside surface 44 of each core lock 41 is dimensioned to fit tightly within the supply roll 1*k*. A tapered end 45 allows each core lock 41 to be inserted in an end of the supply roll 1*k* notwithstanding the tight fit. A stop flange 46 forms a slightly enlarged diameter at one end of the core lock 41 to restrict further insertion once the core lock 41 is fully inserted within the supply roll 1*k*. Once each core lock 41 is inserted into each end of the supply roll 1*k*, the tight fit is generally sufficient to prevent significant relative movement between the core lock 41 and roll 1*k*.

Figure 13B:
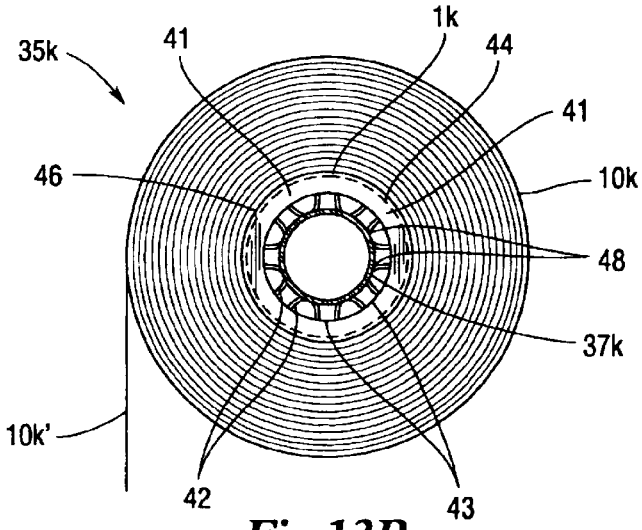
FIG. 13B is a side view of the web of continuously attached pre-opened bags contained on a storage form depicted in FIG. 13A.

The flexible ribs 42 of the core lock 41 are each sufficiently thin and extend sufficiently inward from the rolled inside surface 43 to allow for engagement with the storage rack 37*k* when the storage rack 37*k* is inserted through the core lock 41 and supply roll 1*k* along the axis 40*k*. As best understood with reference to the side view of FIG. 13B, the cross sectional diameter of the storage rack 37*k* is slightly greater than the inside core lock clearance created by the inward reach of the ribs 42, causing slight flexible bending 48 at the tip of each rib 42 as the storage rack 37*k* is inserted into the supply roll 1*k*. The combined flexing of the multiple ribs 42 serves to securely position the storage rack 37*k* at an approximately centered position with respect to the core lock 41 and supply roll 1*k*. Generally, either the ribs 42, storage rack 37*k*, or both are constructed of a material having a low coefficient of friction. The combined contact between the flexible ribs 42 and rack 37*k* is also very small compared to the contact area between the core lock 41 and supply roll 1*k*, which is approximately equal to the total rolled outside surface 44 of the core lock 41. As best viewed in FIG. 13A, the combined contact between the flexible ribs 42 and rack 37 is further reduced by the addition of a reduction notch 47 across each rib 42.

It will further be appreciated that in some embodiments, a core lock can be integrated directly into the structure of a supply roll with each rib extending inwardly and directly from an inside surface of the supply roll structure in order to increase tension against a storage rack.

Due to this substantial differential of friction, the core lock 41 will normally rotate with the supply roll 1*k* about the axis 40*k* when a user pulls an individual pre-opened bag 10*k*' from the web 10*k*, the flexible ribs 42 of the core lock 41 sliding along the outside rolled surface of the storage rack 37*k*. However, the amount of friction between the ribs 42 and storage rack 37*k* is generally sufficient to significantly increase constant tension to cause further relative movement between the open and attached plies of the pre-opened bag 10*k*' being dispensed, further defining the entry point into the bag 10*k*' and possibly aiding in detachment of the bag 10*k*' from the web 10*k*.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method of packaging point-of-purchase items, comprising the steps of:

producing bags as a continuous web, each of said bags being separated from an adjacent bag by a perforated tear line which extends through the web of bags crosswise to a length of the continuous web of bags, each of said bags being sealed along a sealing line adjacent to the perforated tear line;

breaking said perforation line on one side of said continuous web, while retaining at least a partial integrity of said perforation tear line on a remaining side of said web such that a flap defining an entry to each of said bags is formed, thereby forming a continuous web of pre-opened bags;

storing said continuous web of pre-opened bags on a bag supply;

providing said bag supply of said continuous web of pre-opened bags at the point-of-purchase for said items; and loading the point-of-purchase items into at least one of said bags through said entry prior to removal of said at least one bag from a remainder of said continuous web of pre-opened bags.

2. A method according to claim 1, wherein said continuous web is comprised of thermoplastic tubing, and said step of producing includes heat sealing said tubing at selected intervals to thereby form said sealing line.

3. A method according to claim 1, wherein said point-of-purchase items include items provided by a vendor as a bulk commodity for selection and repackaging by a consumer.

4. A method according to claim 3, wherein said bulk commodity includes at least one of fruits, vegetables, nuts and spices.

5. A method according to claim 1 wherein respective width and height dimensions of said bags measured in inches are in a range of about 8×10 to about 16×24.

6. A method according to claim 1, wherein respective width and height dimensions of said bags measured in inches are in a range of about 10×14 to about 12×20.

7. A method according to claim 1, wherein a wall thickness of said bags does not exceed about 1.4 mils.

8. A method according to claim 1, wherein a wall thickness of said bags is in a range of about 0.35 mils to about 0.9 mils.

9. A method according to claim 1, wherein said step of providing said bag supply further comprises providing said continuous web of pre-opened bags on a dispensable supply roll, and further comprising unrolling said continuous web of pre-opened bags from said dispensable supply roll prior to said step of loading.

10. A method of packaging point-of-purchase items comprising:

providing a web of pre-opened bags to a consumer at a point-of-purchase, each of the bags being separated from at least one additional bag by a tear line that extends through the web of pre-opened bags in a direction that is about normal to the length of the web of bags, each bag having an open ply and an attached ply, an insertion edge of the attached ply being adjacent the tear line, and an insertion edge of the open ply of each bag being at least partially separated from at least one ply of an additional bag;

causing each of the bags to be sealed along a sealing line such that when a particular bag is removed from the web of pre-opened bags, it can retain contents placed therein;

pulling one of the bags from the web of pre-opened bags at a location to produce tension to at least partially draw the insertion edge of an open ply away from an insertion edge of an attached ply to define an entry into the bag that is being pulled before the bag that is being pulled breaks off from the web of pre-opened bags; and breaking the bag that is being pulled from the web of pre-opened bags along one of the tear lines.

11. The method of packaging point-of-purchase items of claim 10 further comprising forming a flap with said insertion edge of said open ply to further define the entry into the bag that is being pulled and dispensed.

12. The method of packaging point-of-purchase items of claim 10 further comprising providing an excess portion having an excess edge on at least one bag that is capable of extending to a position in which said excess edge is substantially flush with the tear line and the attached ply of the bag that is being pulled, at least one of the excess edge and the insertion edge of the open ply of the bag that is being pulled being at least partially folded away from the tear line.

13. The method of packaging point-of-purchase items of claim 10 further comprising providing a visual indicator on one of the open ply and attached ply of the bag that is being pulled, the visual indicator denoting a place at about the center of the bag that is being pulled which can be pulled to further open the open ply and the attached ply of the bag that is being pulled apart from each other as the bag that is being pulled is being dispensed from the web of pre-opened bags.

14. The method of packaging point-of-purchase items of claim 10 further comprising:

providing a storage form for containing the web of pre-opened bags;

winding the web of pre-opened bags around a supply roll of the storage form;

providing a locking device on the supply roll of the storage form to increase tension against the dispensing of bags from the storage form when at least one of the bags is pulled as it is being dispersed from the storage form.

15. The method of packaging point-of-purchase items of claim 10 further comprising:

providing a storage form for containing the web of pre-opened bags;

winding the web of pre-opened bags around a supply roll of the storage form;

mounting the supply roll on the storage form to increase tension against the dispensing of bags from the storage form as said roll rotates when at least one of the bags is pulled as it is being dispensed from the storage form.

16. The method of packaging point-of-purchase items of claim 10 further comprising:

providing a storage form for containing the web of pre-opened bags, the storage form including a dispensing rack and at least one core lock that engage the dispensing rack;

winding the web of pre-opened bags around a supply roll of the storage form, the supply roll having an axis;

positioning the supply roll on the core lock to rotate with the core lock about the axis of the supply roll; and causing the core lock to provide tension against the dispensing of bags from the storage form by rotating on the dispensing rack with the supply roll about the axis of the supply roll when at least one of the bags is pulled as it is being dispensed from the storage form.

17. The method of packaging point-of-purchase items of claim 10 further comprising:

providing a storage form for containing the web of pre-opened bags, the storage form including a dispensing rack and at least one core lock having a rolled inside surface, a plurality of ribs extending inwardly from the rolled inside surface of the core lock and engaging the dispensing rack;

winding the web of pre-opened bags around a supply roll of the storage form, the supply roll having an axis;

positioning the supply roll on the core lock to rotate with the core lock about the axis of the supply roll; and causing the ribs of the core lock to provide tension against the dispensing of bags from the storage form by rotating on the dispensing rack with the supply roll about the axis of the supply roll when at least one of the bags is pulled as it is being dispensed from the storage form.

18. The method of packaging point-of-purchase items of claim 10 further comprising:

providing a storage form for containing the web of pre-opened bags;

winding the web of pre-opened bags around a supply roll of the storage form;

providing a ratcheting mechanism on the storage form to increase tension on the supply roll against the dispensing of bags from the storage form and allow the roll to rotate when at least one of the bags is pulled as it is being dispensed from the storage form.

19. The method of packaging point-of-purchase items of claim 10 further comprising providing a visual indicator line on at least one of the open ply and attached ply of the bag that is being pulled, the visual indicator line denoting a place on the bag that is being pulled that can be pulled to further open the open ply and the attached ply of the bag that is being pulled apart from each other as the bag that is being pulled is being dispensed from the web of pre-opened bags.

20. The method of packaging point-of-purchase items of claim 10 further comprising providing a visual tape indicator on at least one of the open ply and the attached ply of the bag that is being pulled, the visual tape indicator denoting a place on the bag that is being pulled that can be pulled to further open the open ply and the attached ply of the bag that is being pulled apart from each other as the bag that is being pulled is being dispensed from the web of pre-opened bags.

21. The method of packaging point-of-purchase items of claim 10 further comprising providing the open ply of the bag that is being pulled with a first color and providing the attached ply of the bag that is being pulled with a second color, the first color being different from the second color, wherein the first and second colors together denote a place on the bag that is being pulled that can be pulled to further open the open ply and the attached ply of the bag that is being pulled apart from each other as the bag that is being pulled is being dispensed from the web of pre-opened bags.

22. The method of packaging point-of-purchase items of claim 10 further comprising providing a vent on at least one of the open ply and the attached ply of the bag that is being pulled to allow for the evacuation of air from between the open ply and the attached ply of the bag that is being pulled during the manufacturing of the web of pre-opened bags.

23. The method of packaging point-of-purchase items of claim 10 wherein said web of pre-opened bags comprises a high-density polyethylene material.

24. The method of packaging point-of-purchase items of claim 10 wherein said web of pre-opened bags comprises a low-density polyethylene material.

* * * * *

UNITED STATES PATENT AND TRADEMARK OFFICE

CERTIFICATE OF CORRECTION

PATENT NO. : 6,948,294 B2
DATED : September 27, 2005
INVENTOR(S) : Jeffrey D. Rabiea It is certified that error appears in the above-identified patent and that said Letters Patent is hereby corrected as shown below:

Column 7,
Line 52, delete “15ºh"x12w"” and replace with -- 15h" x 12w" --.

Column 11,
Line 16, delete “supply roll 11” and replace with -- supply roll 1i --.
Line 22, delete “pawl 381” and replace with -- pawl 38i --.
Line 24, delete “pre-opened bag 101'” and replace with -- pre-opened bag 10i' --.

Signed and Sealed this

Fourteenth Day of February, 2006

JON W. DUDAS
*Director of the United States Patent and Trademark Office*